US010518534B2

(12) United States Patent
Landau et al.

(10) Patent No.: US 10,518,534 B2
(45) Date of Patent: Dec. 31, 2019

(54) IN-LINE PRINTING

(71) Applicant: HP INDIGO B.V., Amstelveen (NL)

(72) Inventors: Yoav Landau, Ness Ziona (IL); On Mashiach, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/022,386

(22) Filed: Jun. 28, 2018

(65) Prior Publication Data

US 2018/0319163 A1 Nov. 8, 2018

Related U.S. Application Data

(63) Continuation of application No. 15/586,532, filed on May 4, 2017, now Pat. No. 10,016,979.

(51) Int. Cl.

| | |
|---|---|
| ***B41J 2/155*** | (2006.01) |
| ***B41J 2/21*** | (2006.01) |
| ***B41J 29/393*** | (2006.01) |
| ***G03G 15/00*** | (2006.01) |
| ***B41J 11/46*** | (2006.01) |

(52) U.S. Cl.

CPC ..... *B41J 2/155* (2013.01); *B41J 2/2135* (2013.01); *B41J 11/46* (2013.01); *B41J 29/393* (2013.01); *G03G 15/50* (2013.01); *B41J 2029/3935* (2013.01)

(58) Field of Classification Search

CPC ..... B41J 29/393; B41J 2029/3935; B41J 2/2135; B41J 11/42; B41J 11/46

See application file for complete search history.

(56) References Cited

U.S. PATENT DOCUMENTS

| | | | | |
|---|---|---|---|---|
| 2006/0039015 | A1* | 2/2006 | Kageyama | B41J 3/54 358/1.5 |
| 2010/0294154 | A1 | 11/2010 | Rapkin | |
| 2010/0296823 | A1 | 11/2010 | Dobbertin | |
| 2014/0313256 | A1* | 10/2014 | Donaldson | B41J 2/2146 347/19 |

(Continued)

FOREIGN PATENT DOCUMENTS

| | | |
|---|---|---|
| CN | 104339892 | 2/2015 |
| KR | 101409485 | 5/2014 |

OTHER PUBLICATIONS

"Ze500 Printer Series—Printer Calibration, Label Registration Issues", https://km.zebra.com/kb/index?page=content&id=SO8465&pmy=print&impressions=false; May 27, 2014.

*Primary Examiner* — Scott A Richmond

(74) *Attorney, Agent, or Firm* — HP Inc. Patent Department

(57) ABSTRACT

In one example of the disclosure, a first print engine is to print a first image in a first area of a web substrate, and is to leave blank a second area of the web substrate. The printed first image includes a set of fiducials 1-n. For each of fiducials 1-n, a fiducial position error is determined based upon a comparison of the detected position and a predicted position for a subject fiducial. A substrate advancement error is calculated based upon an average of the determined fiducial position errors. An insertion point is determined based upon the substrate advancement error. The insertion point is a point at which a second print engine in-line with the first print engine is to begin printing a second image in the second area.

17 Claims, 4 Drawing Sheets

(56) References Cited

U.S. PATENT DOCUMENTS

| | | | | |
|---|---|---|---|---|
| 2015/0015633 | A1* | 1/2015 | Piatt | B41J 11/46 347/16 |
| 2015/0015634 | A1* | 1/2015 | Piatt | B41J 29/42 347/16 |
| 2015/0015635 | A1* | 1/2015 | Piatt | G01B 11/14 347/16 |
| 2015/0266326 | A1* | 9/2015 | Nieda | B41J 2/155 347/19 |

* cited by examiner

IN-LINE PRINTING

BACKGROUND

A printer may apply print agents to a paper or another substrate to produce an image on the substrate. One example of printer is a web-fed printer device, which applies the print agents to a web substrate fed to the printer by a substrate roll feeder system. In an example, a feeder system, sometimes referred to as unwinder, may feed a continuous web substrate to the printer. After application of the print agents, the printed upon substrate may be collected on a re-winder drum or cut into sheets. In certain examples, web-fed printers may apply a print agent that is an electrostatic printing fluid (e.g., electrostatically chargeable toner or resin colorant particles dispersed or suspended in a carrier fluid). In other examples, the print agent may be applied via inkjet or dry toner printing technologies.

DRAWINGS

DETAILED DESCRIPTION

Figure 1:
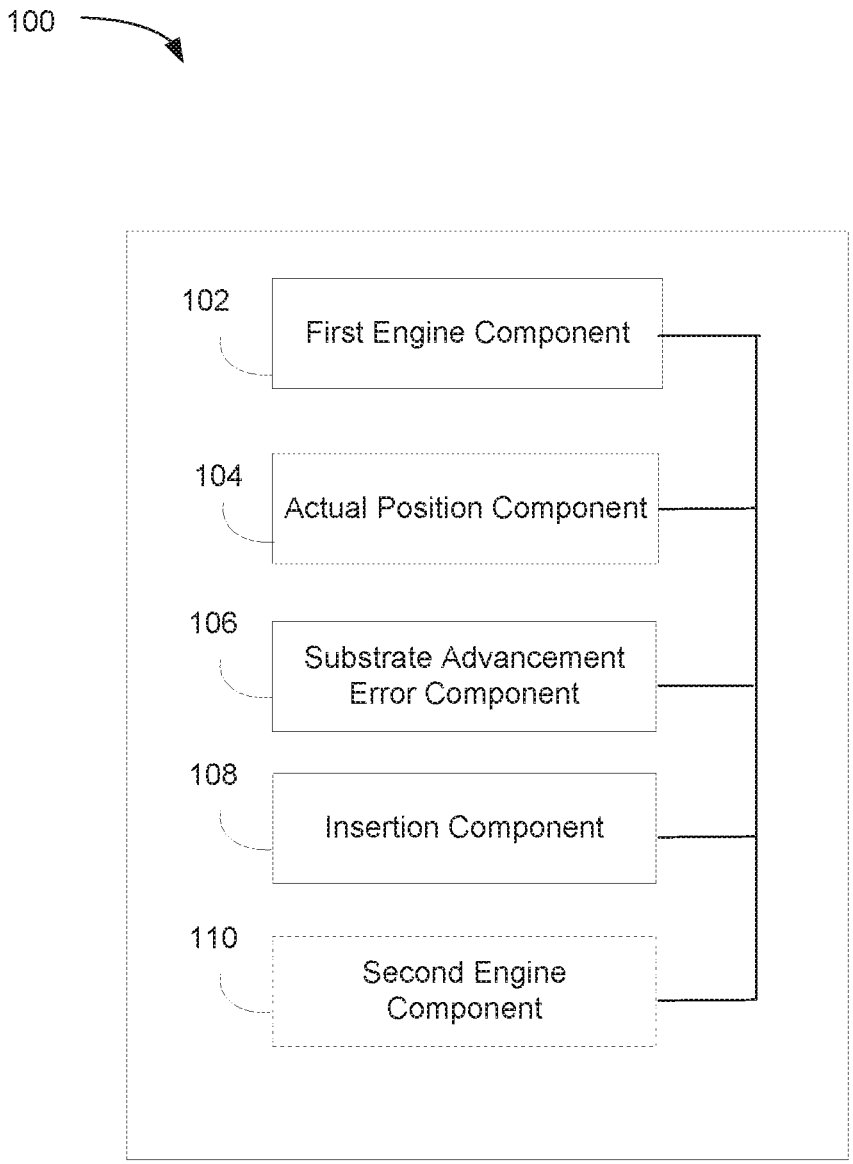
FIG. 1 illustrates an example of a system for in-line printing.

Certain printers increase printing efficiency and speed by employing two in-line print engines simultaneously to create a print job. In an example such a printer may include a first print engine and a second print engine that is situated in-line downstream to the first print engine. The first print engine may print alternating pages of a print job, i.e., page 1, page 3, page 5, etc. sequentially on the web, leaving blank spaces on the web for page 2, page 4, page 6, etc. After page 1, page 3, page 5, etc. are formed on the web by the first engine, the substrate web passes under the second print engine that prints alternating pages between those already printed, i.e., page 2, page 4, page 6, etc.

With any printer locating the images printed on a substrate in a desired location in a consistent manner can be challenging. On a multiple engine press this challenge is even bigger. One approach used to improve accuracy of image registration as between the first and second print engines is to utilize a sensor to detect a mark, reference point or other fiducial on the web to calculate an error in where the fiducial appears relative to when the fiducial is expected to be detected. However, in some use cases inaccurate readings can occur due to vibration of the printer ("sensor jitter"). In other use cases inaccurate readings can occur due to a web substrate "wave movement" that is common as the substrates fed through the printer from an unwinder device. Such inaccurate readings can result in significant registration errors such the printed image has an unacceptable print quality.

To address these issues, various examples described in more detail below provide a system and a method for in-line printing that should significantly improve accuracy of insertion of images upon a web substrate. In an example, a printer includes a first print engine and an in-line second print engine. The first print engine is caused to print a first image in a first area of a web substrate. The printed first image includes a set of fiducials 1-n. The first print engine leaves blank a second area of the web substrate, such the second area may be subsequently printed upon the second print engine. A sensor, e.g., an optical sensor, situated downstream from the first print engine and ahead of a print agent application component of the second print engine is utilized to detect each of the fiducials 1-n in sequence and to identify a detected position for each of the fiducials of the set. For each of the fiducials 1-n, a fiducial position error is determined based upon a comparison of the detected position and a predicted position for the subject fiducial. A substrate advancement error for the web substrate's position based upon an average of the determined fiducial position errors. An insertion point for the second print engine to begin printing a second image in the second area of the web substrate is determined based upon the substrate advancement error. In certain examples, the optical sensor is located within the second print engine. In examples, the predicted position for each subject fiducial of the fiducials among the set of 1-n fiducials is determined by extending, from a fiducial impression point where the first print engine caused printing of the subject fiducial, a predetermined distance along the web. In particular examples, for each of fiducials 1-n the predetermined distance is the distance from the optical sensor to the predicted position of the subject fiducial.

In this manner the disclosed apparatus and method should substantially increase location accuracy in in-line printing utilizing multiple print engines. Errors attributable to sensor jitter and errors attributable to web-handling inaccuracies (e.g. web wave motion errors) will be greatly reduced, and utilization and installations of in-line digital printing devices should thereby be enhanced. The increased accuracy in registration of the images printed by the first and second print engines relative to one another will significantly reduce troubleshooting activities of customers and printing device providers alike as image registration as between the first and second print engines will occur accurately and automatically. Further, users and providers of printing systems will enjoy the cost savings made possible by the disclosed in-line printing system and method, as the increased accuracy in image registration will result in less wasted substrate.

Figure 2:
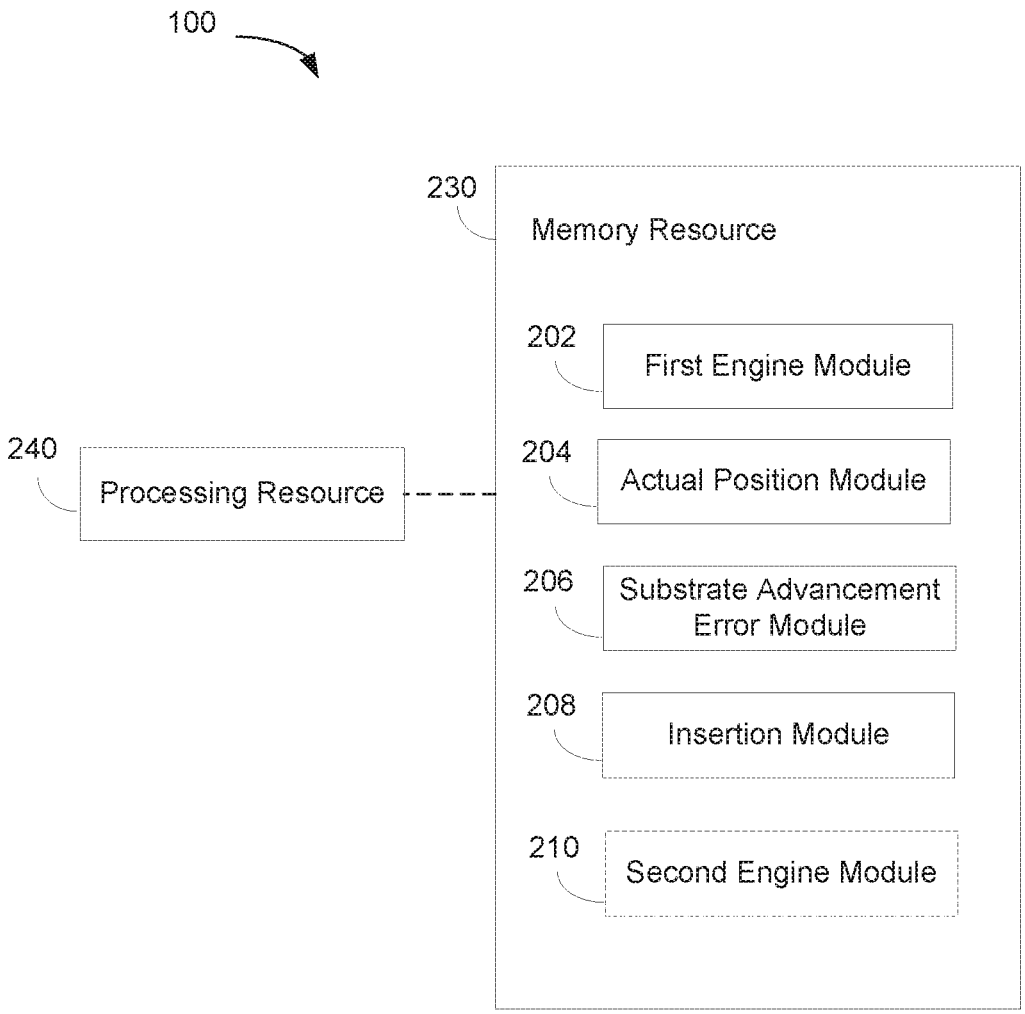
FIG. 2 is a block diagram depicting a memory resource and a processing resource to implement an example of a method of in-line printing.

FIGS. 1 and 2 depict examples of physical and logical components for implementing various examples. In FIG. 1 various components are identified as components 102, 104, 106, 108, and 110. In describing components 102-110 focus is on each components designated function. However, the term component, as used herein, refers generally to hardware and/or programming to perform a designated function. As is illustrated with respect to FIG. 2, the hardware of each component, for example, may include one or both of a processor and a memory, while the programming may be code stored on that memory and executable by the processor to perform the designated function.

FIG. 1 illustrates an example of a system 100 for in-line printing. In this example, system 100 includes a first engine component 102, an actual position component 104, a substrate advancement error component 106, and an insertion component 108. Certain examples may include a second image component 110, In performing their respective functions, components 102-110 may access a data repository, e.g., a memory accessible to system 100 that can be used to store and retrieve data.

In an example, first engine component 102 represents generally a combination of hardware and programming to cause a first print engine of a multiple print engine printer to form a first image in a first area of a web substrate, while leaving a blank area at a second area of the web substrate. The first image printed by the first engine includes a set of fiducials 1-n. As used herein, a "fiducial" refers generally to a rectangle, an oval, a line segment, dot, spot, cross, or other geometrical shape or other visual feature that may be placed in the focal plane of a sensor and used as a reference point for measuring a distance. As used herein a "print engine" refers to generally to a set of components that are utilized to apply a print agent to a substrate. In a particular example, the multiple print engine printer may be a Liquid Electro-Photographic ("LEP") such as the HP Indigo 8000 press. In the example of LEP printing, the print agent application components at the printer may include a photoconductor, charge element, intermediate transfer member or blanket, and/or impression drum. In another example, the multiple print engine printer may be an inkjet printer, and the print agent application components may include a printbar of other set of thermal inkjet or piezo printheads. In another example, the multiple print engine printer may be a dry toner laser printing, and the print agent application components may include a photoconductor, dry toner cartridge, and/or a fuser element.

Actual position component 104 represents generally a combination of hardware and programming to detect, and identify a detected position for, each of the fiducials 1-n. In examples, actual position component 104 may utilize an optical sensor that is situated downstream of the first print engine and upstream of a print agent application component of the second print engine to detect each of fiducials 1-n in sequence. In certain examples, the optical sensor utilized for detecting each of the fiducials 1-n is included as a component of the second print engine. In other examples, actual position component 104 could utilize an optical sensor that is downstream from the first print engine and upstream from the second print engine.

Substrate advancement error component 106 represents generally a combination of hardware and programming to determine, for each fiducials 1-n, a fiducial position error based upon a comparison of the detected position and a predicted position for a subject fiducial. In examples, the predicted position for each subject fiducial of the fiducials may be a position determined by extending, from a fiducial impression point where the first print engine caused printing of the subject fiducial, a predetermined distance along the web. In a particular example, the predetermined distance is a distance from the first fiducial impression point to the optical sensor located downstream of the first fiducial impression point, wherein this optical sensor is utilized for detecting the printed set of fiducials. In some examples, the optical sensor may be a component of the second print engine. After determining fiducial position errors for each of fiducials 1-n, substrate advancement error component 106 is to calculate a substrate advancement error based upon an average of the determined fiducial position errors for fiducials 1-n.

Insertion component 108 represents generally a combination of hardware and programming to determine, based upon the substrate advancement error, an insertion point for the second print engine to begin printing a second image in the second area. For instance, insertion component 108 in some examples may determine such insertion point by adjusting an anticipated position for the second image by the substrate advancement error. In certain examples, the anticipated position for the second image may be predefined distance from an impression point at which the fiducials were printed. In other examples, the anticipated position for the second image may be predefined distance from a particular fiducial of the set of printed fiducials.

The second print engine is an engine that is in-line with the first print engine. As used herein, the first and second print engines being "in-line" with another refers generally to the first and second print engines being situated to print upon a common or same web substrate. The in-line first print engine characterizes the engine upstream relative the second print engine when considering the direction of web substrate movement during the two engine printing process.

In certain examples in-line printing system 100 will also include a second engine component 110. Second engine component 110 represents generally a combination of hardware and programming to cause the second print engine to print the second image in the second area, with printing beginning at the determined insertion point.

In the foregoing discussion of FIG. 1, components 102-110 were described as combinations of hardware and programming. Components 102-110 may be implemented in a number of fashions. Looking at FIG. 2 the programming may be processor executable instructions stored on a tangible memory resource 230 and the hardware may include a processing resource 240 for executing those instructions. Thus memory resource 230 can be said to store program instructions that when executed by processing resource 240 implement system 100 of FIGS. 1 and 2.

Memory resource 230 represents generally any number of memory components capable of storing instructions that can be executed by processing resource 240. Memory resource 230 is non-transitory in the sense that it does not encompass a transitory signal but instead is made up of a memory component or memory components to store the relevant instructions. Memory resource 230 may be implemented in a single device or distributed across devices. Likewise, processing resource 240 represents any number of processors capable of executing instructions stored by memory resource 230. Processing resource 240 may be integrated in a single device or distributed across devices. Further, memory resource 230 may be fully or partially integrated in the same device as processing resource 240, or it may be separate but accessible to that device and processing resource 240.

In one example, the program instructions can be part of an installation package that when installed can be executed by processing resource 240 to implement system 100. In this case, memory resource 230 may be a portable medium such as a CD, DVD, or flash drive or a memory maintained by a server from which the installation package can be downloaded and installed. In another example, the program instructions may be part of an application or applications already installed. Here, memory resource 230 can include integrated memory such as a hard drive, solid state drive, or the like.

In FIG. 2, the executable program instructions stored in memory resource 230 are depicted as first engine module 202, actual position module 204, substrate advancement error module 206, insertion module 208, and second engine module 210. First engine module 202 represents program instructions that when executed by processing resource 240 may perform any of the functionalities described above in relation to first engine component 102 of FIG. 1. Actual position module 204 represents program instructions that when executed by processing resource 240 may perform any of the functionalities described above in relation to actual position component 104 of FIG. 1. Substrate advancement error module 206 represents program instructions that when executed by processing resource 240 may perform any of the functionalities described above in relation to substrate advancement error component 106 of FIG. 1. Insertion module 208 represents program instructions that when executed by processing resource 240 may perform any of the functionalities described above in relation to ventilation component 108 of FIG. 1. Second engine module 210 represents program instructions that when executed by processing resource 240 may perform any of the functionalities described above in relation to second image component 110 of FIG. 1.

Figure 3A:
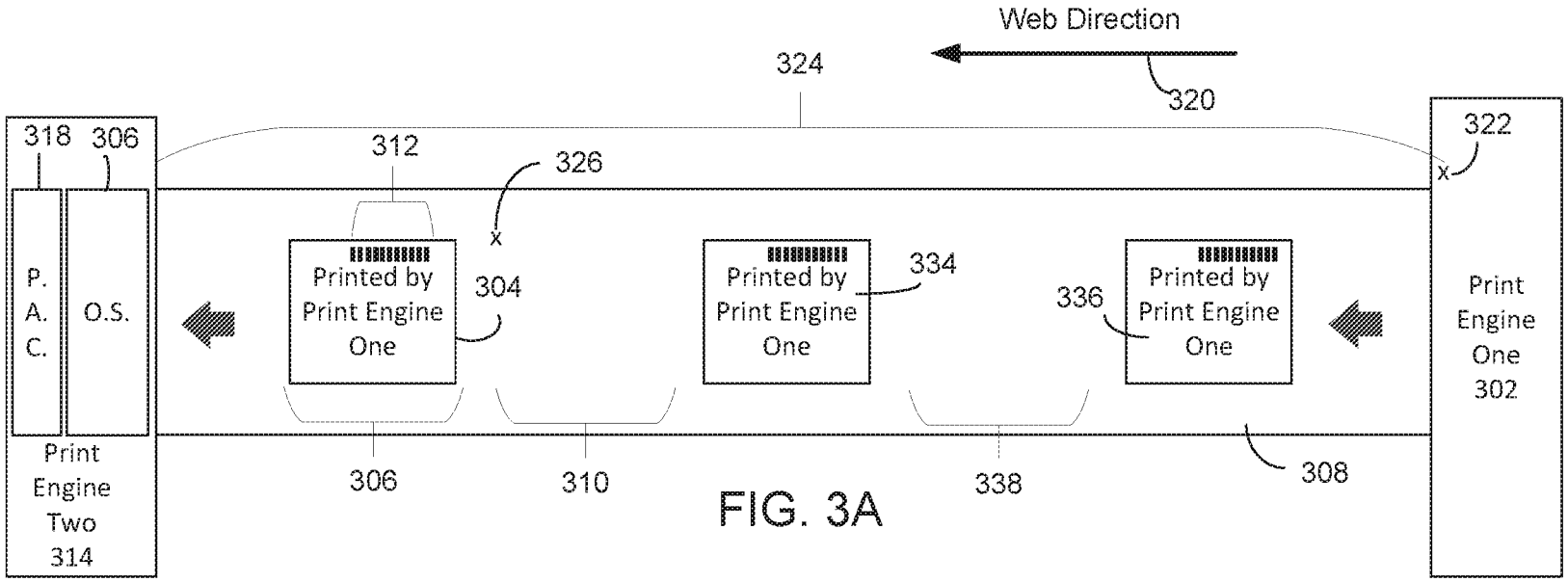
FIGS. 3A and 3B illustrate an example of determination of an insertion point for an in-line print engine to begin printing based upon a calculated substrate advancement error.
Figure 3B:
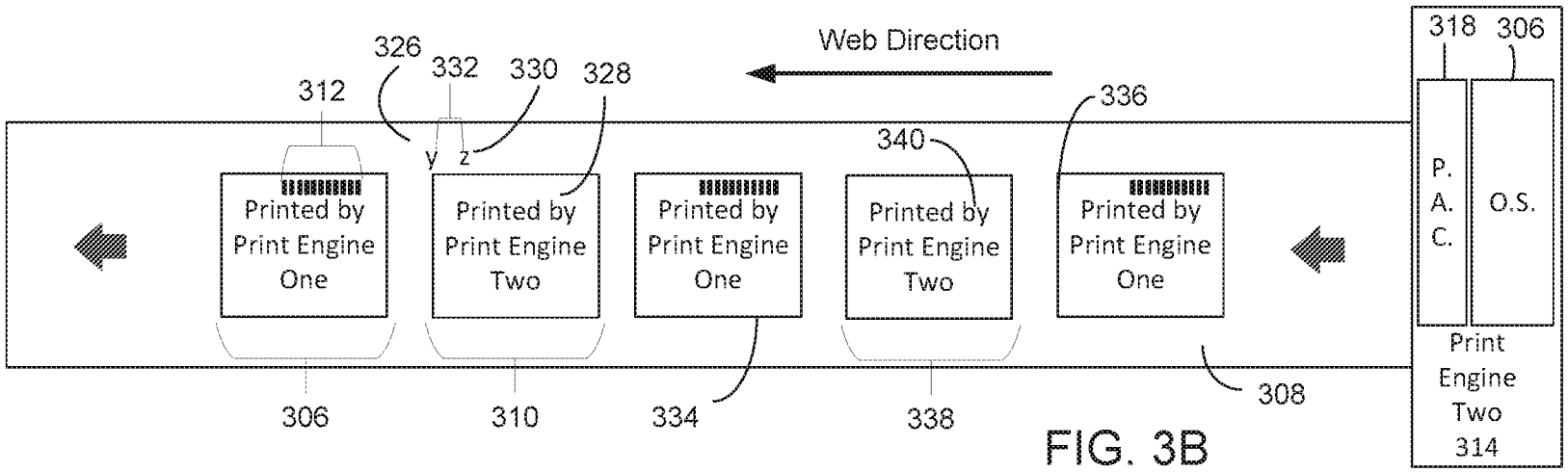

FIGS. 3A and 3B illustrate an example of determination of an insertion point for an in-line print engine to begin printing based upon a calculated substrate advancement error. Starting at FIG. 3A, in this example of an in-line printing system a first print engine 302 prints a first image 304 in a first area 306 of a web substrate 308, leaving blank a second area 310 of the web substrate 308. The printed first image 304 includes a set of fiducials 1-n 312.

In the example of FIG. 3A the set of fiducials 1-n is a set of eleven fiducials. In other particular example, the set of fiducials 1-n may be a set including between two and ten fiducials. In yet other particular example, the set of fiducials 1-n may be a set including between twelve and fifteen fiducials.

A second print engine 314 is situated in-line to the first print engine 302 that produced the first image 304 with the fiducials 312. The second print engine 314 is for printing images in the spaces on the substrate left blank by the first print engine 302, e.g., the blank second area 310 referred to in the preceding paragraph.

An optical sensor 316 is situated in view of the web substrate 308, downstream of the first print engine 302 and upstream of a print application component 318 of the second print engine 314. "Downstream" and "upstream" are relative to a web direction 320 that is the direction the web substrate 308 travels as moves from the first print engine 302 to the second print engine 314. In the example of FIG. 3A the optical sensor 306 is included in, e.g., is a component of, the second print engine 314. In other examples, the optical sensor may be situated downstream from the first print engine 302 and upstream from a print application component 318 of the second print engine 314, and yet separate and removed from the body of the second print engine 314.

The optical sensor 306 is utilized to detect each of the fiducials 1-n 312, and to identify a detected position for each of fiducials 1-n 312. Such detection and identification of the fiducials 1-n 312 occurs sequentially as the web substrate proceeds in the web direction 320 to arrive at the second print engine 314.

A fiducial position error is determined for each subject fiducial of fiducials 1-n 312, based upon a comparison of the identified detected position 330 for the subject fiducial and a predicted position 332 for the subject fiducial. In certain examples, the predicted position for each subject fiducial of the fiducials among the set of 1-n fiducials 312 is a predicted position that is determined by extending, from a fiducial impression point "x" 322 where the first print engine 302 caused printing of the subject fiducial, a predetermined distance 324 along the web substrate. In this example, the predetermined distance 324 is a distance from the first fiducial impression point 322 to the optical sensor 306 downstream of the first fiducial impression point 322. In other examples, the predicted position for the subject fiducial may be a position that is established by other means. A substrate advancement error is calculated based upon an average of the determined fiducial position error for each of fiducials 1-n 312.

Moving to FIG. 3B, an insertion point "y" 326 at the web substrate 308 is determined, the insertion point "y" 326 being a point at which the second print engine 314 is to begin printing a second image 328 in the second area 310. In a particular example, insertion point "y" 326 may be determined by adjusting an anticipated position "z" 330 for the second image 328 by amount of the determined substrate advancement error 332. The second print engine 314 may in turn be caused to print the second image 328 in the second area 310, with printing beginning at the determined insertion point "y" 326.

FIGS. 3A and 3B further illustrate that the in-line printing insertion points determination method and system disclosed herein are contemplated for use with multiple page print jobs of any page count. For instance, first image 306 may be a first page of a multi-page print job, and first print engine 302 may print sequentially a third page 334, a fifth page 336, and so on, leaving blank areas (e.g., blank area 310, blank area 338, and so on) for the second print engine 314 to print the second page 340, a fourth page, and so on.

Figure 4:
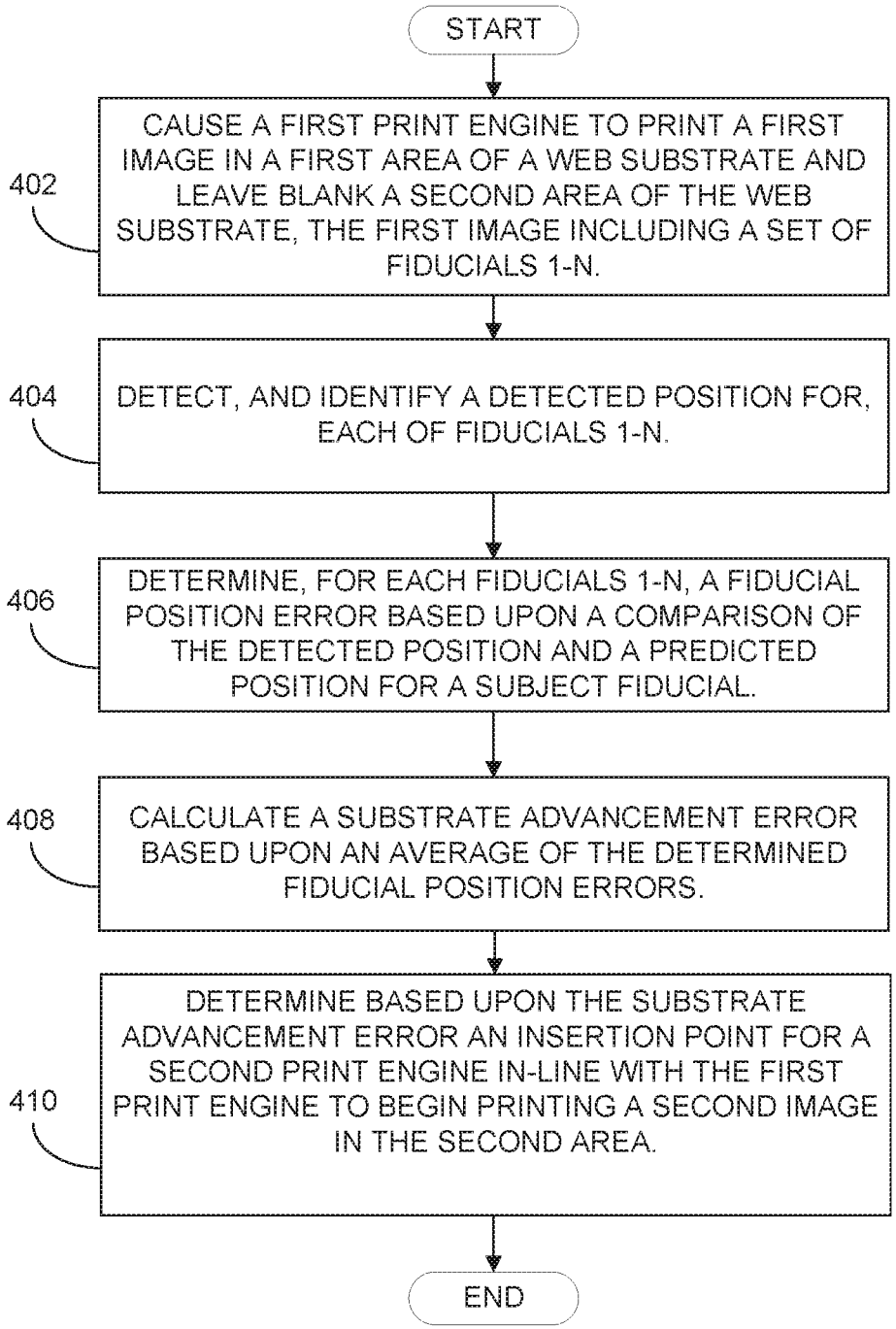
FIG. 4 is a flow diagram depicting implementation of an example of a method of in-line printing.

FIG. 4 is a flow diagram of implementation of a method for in-line printing that includes determining an insertion point for a second print engine of a multiple print engine printer to begin printing utilizing fiducials printed by a first print engine that is inline at the same printer. In discussing FIG. 4, reference may be made to the components depicted in FIGS. 1 and 2. Such reference is made to provide contextual examples and not to limit the manner in which the method depicted by FIG. 4 may be implemented. A first print engine is caused to print a first image in a first area of a web substrate, and to leave blank a second area of the web substrate. The first image including a set of fiducials 1-n (block 402). Referring back to FIGS. 1 and 2, first engine component 102 (FIG. 1) or first engine module 202 (FIG. 2), when executed by processing resource 240, may be responsible for implementing block 402.

Each of fiducials 1-n is detected, and a detected position is identified for each fiducial (block 404). Referring back to FIGS. 1 and 2, actual position component 104 (FIG. 1) or actual position module 204 (FIG. 2), when executed by processing resource 240, may be responsible for implementing block 404.

A fiducial position error is determined for each fiducials 1-n based upon a comparison of the detected position and a predicted position for a subject fiducial (block 406), Referring back to FIGS. 1 and 2, substrate advancement error component 106 (FIG. 1) or substrate advancement error module 206 (FIG. 2), when executed by processing resource 240, may be responsible for implementing block 406.

A substrate advancement error is calculated based upon an average of the determined fiducial position errors (block 408). Referring back to FIGS. 1 and 2, substrate advancement error component 106 (FIG. 1) or substrate advancement error module 206 (FIG. 2), when executed by processing resource 240, may be responsible for implementing block 408.

An insertion point is determined based upon the substrate advancement error. The insertion point is a point where a second print engine in-line with the first print engine is to begin printing a second image in the second area (block 410). Referring back to FIGS. 1 and 2, insertion component 108 (FIG. 1) or insertion module 208 (FIG. 2), when executed by processing resource 240, may be responsible for implementing block 410.

FIGS. 1-4 aid in depicting the architecture, functionality, and operation of various examples. In particular, FIGS. 1 and 2 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function(s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 4 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A system for in-line printing, comprising:

a first print engine to print a first image in a first area of a web substrate and leave blank a second area of the web substrate, the first image including a set of fiducials;

a second print engine in-line with, and downstream from, the first print engine;

an optical sensor to detect each fiducial, comprising a position component to identify a detected position for each of the fiducials;

a substrate advancement error component to determine, for each fiducial, a fiducial position error based upon a comparison of the detected position and a predicted position of each fiducial, and to calculate a substrate advancement error based upon the determined fiducial position errors; and an insertion component to determine, based upon the substrate advancement error, an insertion point at which the second print engine in-line with the first print engine is to begin printing a second image in the second area.

2. The system of claim 1, wherein the optical sensor is located in the second print engine.

3. The system of claim 1, wherein the optical sensor is located between the first and second engines.

4. The system of claim 1, wherein the predicted position of each fiducial is a position determined by extending, from a fiducial impression point where the first print engine caused printing of the subject fiducial, a predetermined distance along the web.

5. The system of claim 4, wherein the predicted position of each fiducial is a distance from the corresponding fiducial impression point to the optical sensor located downstream of the first fiducial impression point.

6. The system of claim 1, Wherein the substrate advancement error is based upon an average of the determined fiducial position errors.

7. The system of claim 1, wherein the set of fiducials is a set including between two and fifteen fiducials.

8. The system of claim 1, wherein the insertion component is to determine the insertion point by adjusting an anticipated position for the second image by the amount of the substrate advancement error.

9. The system of claim 1, further comprising a second engine component, to cause the second print engine to print the second image in the second area, with printing beginning at the insertion point.

10. A method for in-line printing with the system of claim 1, the method comprising:

with the first print engine, printing the first image in the first area of the web substrate and leaving blank a second area of the web substrate, the first image including a set of fiducials;

with the optical sensor, detecting each fiducial, and, with the position component, identifying a detected position for each of the fiducials;

with the substrate advancement error component, determining, for each fiducial, a fiducial position error based upon a comparison of the detected position and a predicted position of each fiducial, and calculating the substrate advancement error based upon the determined fiducial position errors;

with the insertion component, determining, based upon the substrate advancement error, an insertion point at which the second print engine in-line with the first print engine is to begin printing the second image in the second area.

11. The method of claim 10, further comprising, with the second print engine, printing the second image in the second area.

12. The method of claim 10, wherein the optical sensor is located in the second print engine.

13. The method of claim 10, wherein the optical sensor is located between the first and second engines.

14. The method of claim 10, further comprising determining the predicted position of each fiducial by extending, from a fiducial impression point where the first print engine caused printing of the subject fiducial, a predetermined distance along the web.

15. The method of claim 14, further comprising determining the predicted position of each fiducial by determining a distance from the corresponding fiducial impression point to the optical sensor located downstream of the first fiducial impression point.

16. The method of claim 14, wherein the substrate advancement error is based upon an average of the determined fiducial position errors.

17. The method of claim 10, wherein the insertion component is to determine the insertion point by adjusting an anticipated position for the second image by the amount of the substrate advancement error.

* * * * *